US008435129B2

(12) United States Patent
Miller

(10) Patent No.: US 8,435,129 B2
(45) Date of Patent: May 7, 2013

(54) APPARATUS AND METHOD TO PRACTICE GOLF SWING

(76) Inventor: Christopher J Miller, Palm Beach Gardens, FL (US)

( * ) Notice: Subject to any disclaimer, the term of this patent is extended or adjusted under 35 U.S.C. 154(b) by 0 days.

(21) Appl. No.: 13/066,905

(22) Filed: Apr. 27, 2011

(65) Prior Publication Data

US 2012/0277019 A1 Nov. 1, 2012

(51) Int. Cl.
*A63B 69/36* (2006.01)

(52) U.S. Cl.
USPC ..... 473/256; 473/409

(58) Field of Classification Search ..... 473/219, 473/226, 234, 256, 316, 457, 409
See application file for complete search history.

(56) References Cited

U.S. PATENT DOCUMENTS

| | | | | |
|---|---|---|---|---|
| 5,082,279 | A * | 1/1992 | Hull et al. | 473/242 |
| 5,330,190 | A * | 7/1994 | Oakley, Jr. | 473/234 |
| 5,976,031 | A * | 11/1999 | Johnson | 473/300 |
| 6,949,036 | B2 * | 9/2005 | Ciesar et al. | 473/457 |
| 7,147,568 | B1 * | 12/2006 | Butler | 473/239 |
| 7,625,295 | B2 * | 12/2009 | Gutierrez | 473/256 |
| 7,935,011 | B1 * | 5/2011 | Krbec | 473/549 |
| 2005/0054459 | A1 * | 3/2005 | Oldenburg | 473/297 |

* cited by examiner

*Primary Examiner* — Nini Legesse
(74) *Attorney, Agent, or Firm* — Tod R. Nissle, P.C.

(57) ABSTRACT

A golf practice device replicates in large part a golf club, provided, however the weighting in the device facilitates maintaining a golfer's arms in close proximity in a "V" configuration and facilitates during a golf swing the return of a golf club to its starting position just prior to contacting and hitting a golf ball.

3 Claims, 6 Drawing Sheets

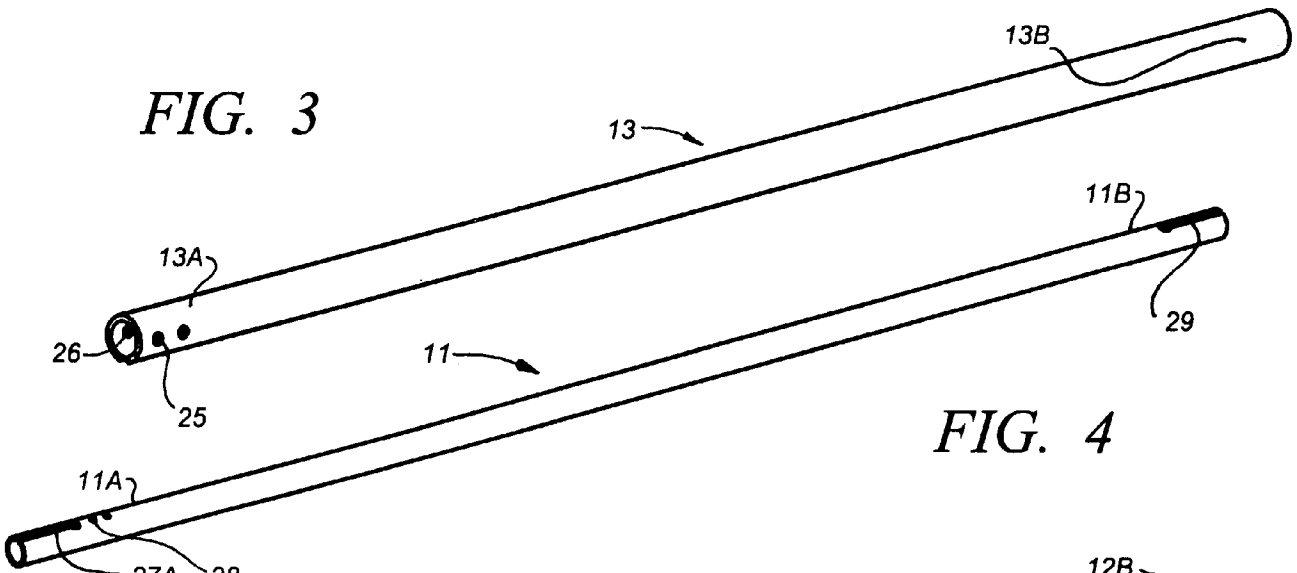
FIG. 3
FIG. 4
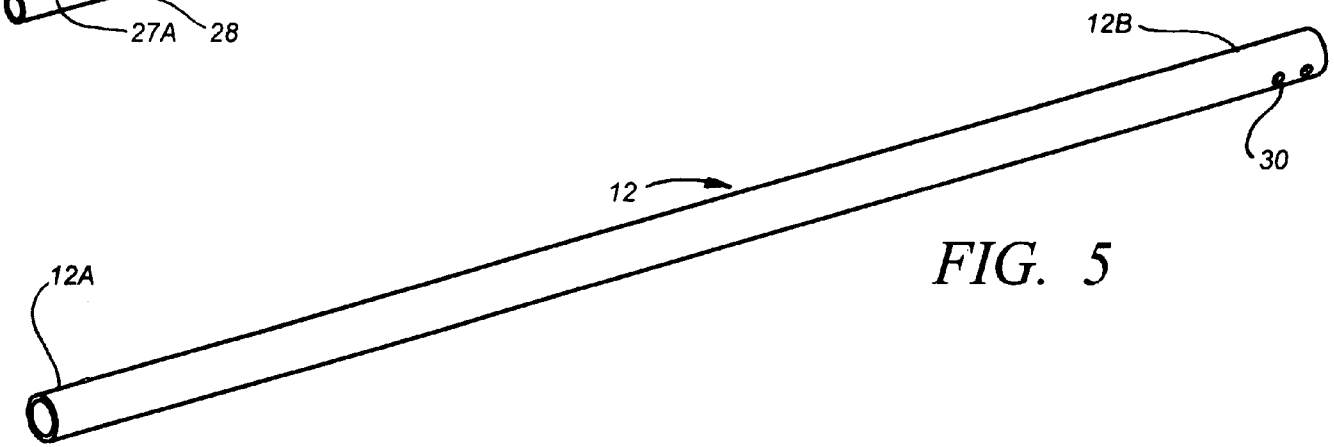
FIG. 5

APPARATUS AND METHOD TO PRACTICE GOLF SWING

This invention relates to an apparatus and method to practice a golf swing.

A long existing motivation in the field of golf is to provide methods to improve a player's golf swing. There are many methodologies utilized by golf instructors to teach how to practice and improve a player's golf swing.

Accordingly, it would be highly desirable to provide an improved method and apparatus to practice a golf swing.

Therefore, it is a principal object of the invention to provide an improved method and apparatus to improve the golf swing of a player.

This and other, further and more specific objects of the invention will be apparent to those skilled in the art from the following detailed description thereof, taken in conjunction with the drawings, in which:

FIG. 3 is a perspective view illustrating a component of the apparatus of FIG. 1;

FIG. 4 is a perspective view illustrating a component of the apparatus of FIG. 1;

FIG. 5 is a perspective view illustrating a component of the apparatus of FIG. 1;

Figure 1:
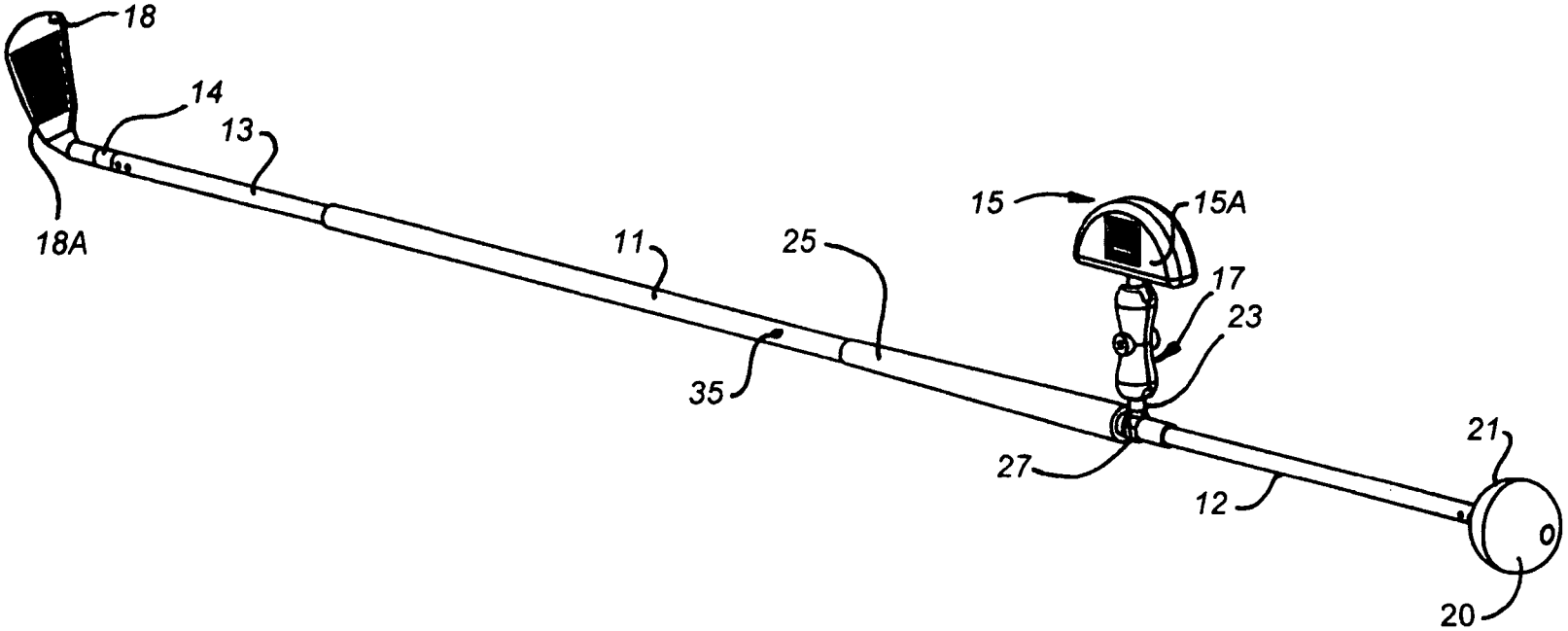
FIG. 1 is a perspective view illustrating a golf practice apparatus constructed in accordance with the invention.

Briefly, in accordance with the invention, I provide an improved elongate golf practice device. The practice device comprises an elongate hollow shaft assembly having a length greater than that of a normal golf club and including a hollow tubular top section having a distal end, a hollow tubular bottom section having a distal end, and a hollow middle section extending between and interconnecting the top and the bottom sections; a handle mounted on the middle section; a club head attached to the distal end of the bottom section; a first counterweight attached to the distal end of the top section; and, at least one secondary counterweight removably slidably mounted in at least one of a group consisting of the top section, the bottom section, and the middle section. The golf practice device has a weight greater than that of a comparable golf club.

In another embodiment of the invention, provided is an improved method to practice a golf swing. The method comprises the step of providing an elongate golf practice device. The practice device comprises an elongate hollow shaft assembly having a length greater than that of a normal golf club and including a hollow tubular top section having a distal end, a hollow tubular bottom section having a distal end, and a hollow middle section extending between and interconnecting the top and the bottom sections; a handle mounted on the middle section; a club head attached to the distal end of the bottom section; a first counterweight attached to the distal end of the top section; and, at least one secondary counterweight removably slidably mounted in at least one of a group consisting of the top section, the bottom section, and the middle section. The method also includes the steps of grasping the handle of the golf practice device; taking a stance addressing a golf ball; positioning the golf practice device such that the club head is adjacent the golf ball, and the first counterweight is in an operative position adjacent the stomach; and, swinging the golf practice device while generally maintaining the first counterweight adjacent the stomach. The golf practice device has a weight greater than that of a comparable golf club.

In a further embodiment of the invention, I provide an elongate golf practice device. The device comprises an elongate hollow shaft assembly having a length greater than that of a comparable conventional golf club and including a top section having a proximate end and a distal end; a bottom section having a proximate end and a distal end; and, a hollow middle section extending between and interconnecting the proximate ends of the top and bottom sections. The device also includes a handle on the middle section; a club head attached to the distal end of the bottom section; and, a first counterweight attached to the distal end of the top section and spaced apart from the handle. The device has a weight greater than that of a comparable conventional golf club; and, a center of gravity spaced along the middle section a distance from the club head greater than the distance the center of gravity of a comparable conventional golf club is spaced apart from the club head of the conventional golf club.

In still another embodiment of the invention, I provide a method to practice a golf swing. The method includes the step of providing a golf practice device. The device comprises an elongate hollow shaft assembly having a length greater than that of a comparable conventional golf club and including a top section having a proximate end and a distal end; a bottom section having a proximate end and a distal end; and, a hollow middle section extending between and interconnecting the proximate ends of the top and bottom sections. The device also includes a handle on the middle section; a club head attached to the distal end of the bottom section; and, a first counterweight attached to the distal end of the top section and spaced apart from the handle. The device has a weight greater than that of a comparable conventional golf club; and, a center of gravity spaced along the middle section a distance from the club head greater than the distance the center of gravity of a comparable conventional golf club is spaced apart from the club head of the conventional golf club. The method also includes the steps of grasping the handle of the golf practice device; taking a stance addressing a golf ball; positioning the golf practice device such that club head of the golf practice device is adjacent said golf ball, and, the first counterweight is in an operative position adjacent the torso; and, swinging the golf practice device while during the initial part of the back swing generally maintaining the first counterweight adjacent the torso, and during the down swing just prior to and just after contacting the golf ball with the club head of the golf practice device maintaining the first counterweight adjacent the torso.

In still a further embodiment, provided is an elongate golf practice device. The device comprises an elongate hollow shaft assembly including a hollow tubular middle section having a first end and a second end; a hollow tubular top section having a first end slidably and lockably connected proximate the first end of the middle section and having a second end; and, a hollow tubular bottom section having a first end, and a second end slidably and lockably connected proximate the second end of said middle section. The device also includes a handle on the middle section proximate the first end of the middle section and selected from a group consisting of a standard golf grip, a training golf grip, and a custom golf grip; a hosel adapter capable of receiving a plurality of club heads, the hosel adapter being removably attached to the first end of the bottom section; a first counterweight removably attached to the second end of the top section; and, at least one secondary counterweight removably and slidably mounted in at least one of a group consisting of the top section and the bottom section.

Turning now to the drawings, which depict the presently preferred embodiments of the invention for the purpose of illustration thereof, and not by way of limitation of the invention, and in which like characters refer to corresponding elements throughout the several views, FIGS. 1 to 8 illustrate an elongate golf practice device constructed in accordance with the invention and generally indicated by reference character 10.

Figure 2:
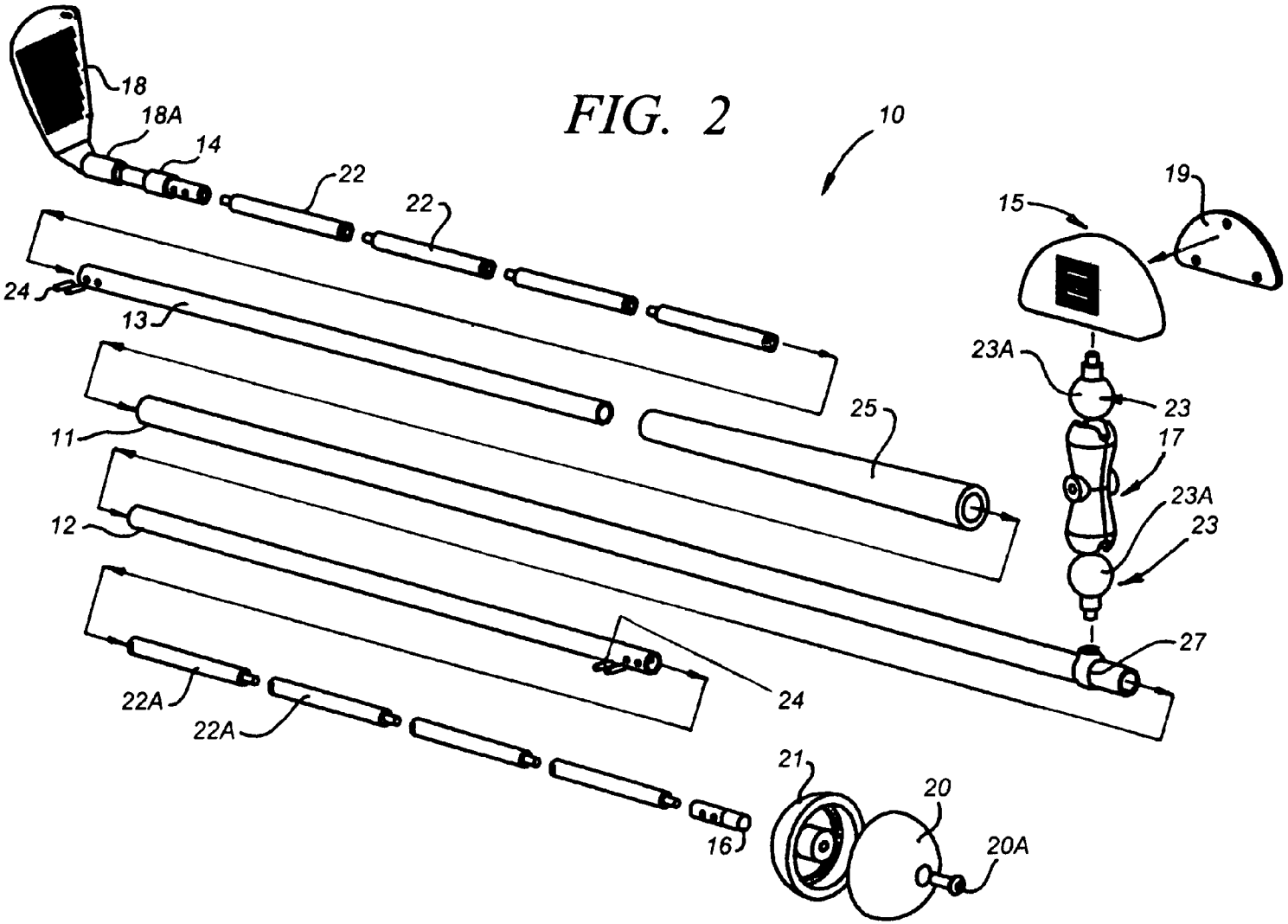
FIG. 2 is an exploded perspective assembly view of the apparatus of FIG. 1.

In FIG. 2, the practice device 10 includes a club head 18, a hosel adapter 14, four secondary counterweights 22, bottom shaft section 13 that can slidably receives counterweights 22, handle 25, middle shaft section 11, top shaft section 12 that can slidably receive counterweights 22A, four more secondary counterweights 22, counterweight adapter 16, counterweight 21, and counterweight cover 20. Ball mount boss 27 is slidably, fixedly mounted on one end of the middle shaft section 11. The lower end of one ball mount 23 is attached to boss 27. The upper end of the other ball mount 23 is attached to semi-cylindrically shaped hollow housing 15. The spherical ball member 23A of each mount 23 is rotatably mounted in double socket mount 17. Semi-circular cover plate 19 is secured to the back of housing 15.

FIG. 1 illustrates the practice device 10 of FIG. 2 assembled.

FIG. 3 further illustrates the hollow tubular bottom shaft section 13. Section 13 includes distal end 13A and proximate end 13B. End 13B is shaped and dimensioned to slide into (or, if desired, over) middle shaft section 11. Distal end 13A includes a first adjacent pair of adjacent spaced-apart apertures 25 on one side of end 13A that are in registration with an opposing pair of adjacent spaced-apart apertures 26 on the opposite side of end 13A.

FIG. 4 further illustrates the hollow tubular middle shaft section 11. Section 11 includes first end 11A and second end 11B. End 11B has slot 29 formed therein. End 11A has a slot 27A and a pair of spaced apart apertures formed therein.

FIG. 5 further illustrates the hollow tubular top shaft section 12. Section 12 includes distal end 12B and proximate end 12A. End 12B is shaped and dimensioned to slide into (or, if desired, over) middle shaft section 11. Distal end 12B includes a first adjacent pair of adjacent spaced-apart apertures 30 on one side of end 12B that are in registration with an opposing pair of spaced-apart apertures (not visible in FIG. 5) on the opposite side of end 12B.

Figure 6:
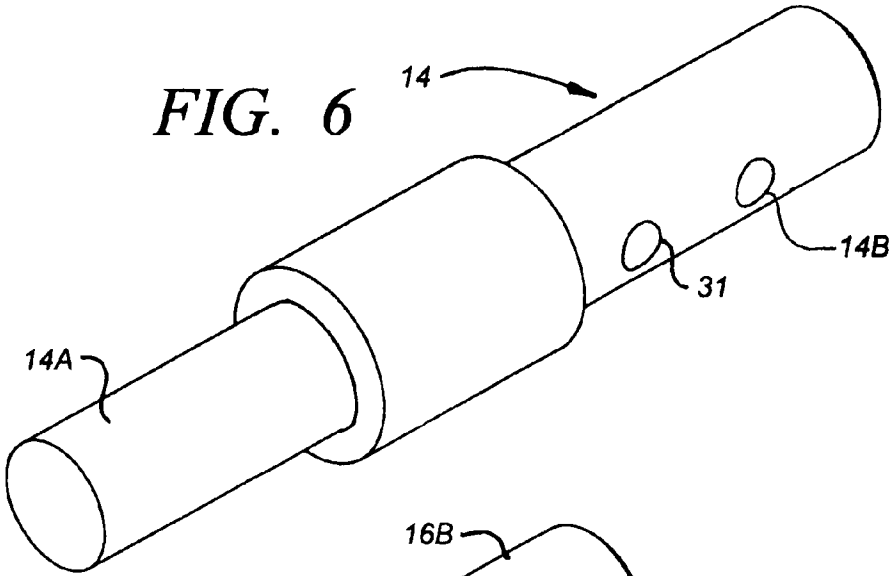
FIG. 6 is a perspective view illustrating a component of the apparatus of FIG. 1.

FIG. 6 further illustrates the hosel adapter 14. Adapter 14 includes distal end 14A and proximate end 14B. A pair of spaced-apart apertures 31 extend completely through proximate end 14B.

Figure 7:
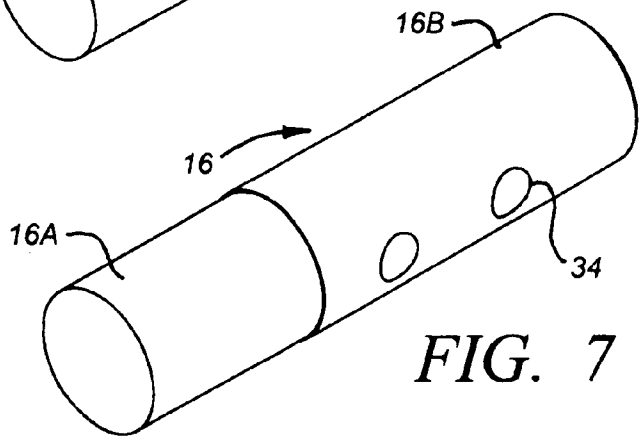
FIG. 7 is a perspective view illustrating a component of the apparatus of FIG. 1.

FIG. 7 further illustrates the counterweight adapter 16. Adapter 16 includes proximate end 16B and distal end 16A. A pair of spaced apart apertures 34 extend completely through proximate end 16B.

Figure 8:
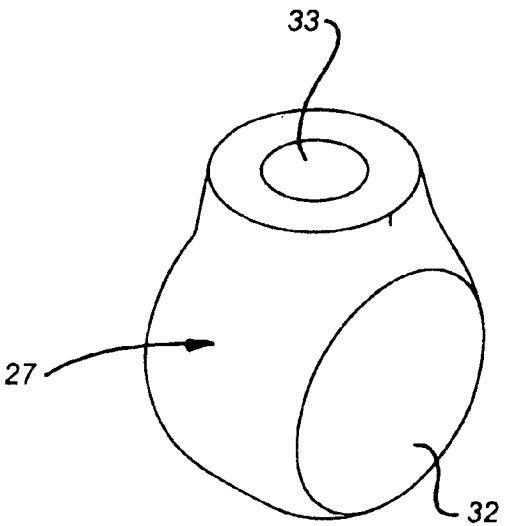
FIG. 8 is a perspective view illustrating a component of the apparatus of FIG. 1.

FIG. 8 further illustrates the boss 27. Boss 27 includes cylindrical aperture 32 formed therethrough, and includes cylindrical aperture 33 extending inwardly to intersect with aperture 32.

During assembly of the various components illustrated in FIG. 2, club head 18 is a three iron club head with a hollow hosel 18A. Hosel 18A is slidably removably secured to distal end 14A of hosel adapter 14. A set screw (not shown) in hosel 18A or any other means can be used to secure removably hosel 18A to the distal end 14A of adapter 14. Club head 18 can comprise a two iron club head, four iron club head, driver club head, or any other desired club head. None of the counterweights 22 or one or more of the counter weights 22 can be slidably inserted inside shaft section 13. Handle 25 slides over middle shaft section 11 to the position illustrated in FIG. 1.

The proximate end 14B of hosel adapter 14 is slidably inserted in the distal end 13A of bottom shaft section 13 such that apertures 31 are in alignment and registration with apertures 25 and 26 and pins 24 (FIG. 2) are inserted through apertures 25, 31, 26 to secure removably the hosel adapter 14 to section 13.

The proximate end 13B of bottom shaft section 13 is slidably inserted selected distance into first end 11A of middle shaft section 11, and is secured in end 11A with a set screw (not shown) or other desired attachment apparatus. Aperture 32 of boss 27 is slid over the second end 11B of middle shaft section 11 and boss 27 is secured to section 11 at the position illustrated in FIG. 1. The spherical balls 23A of each mount 23 are rotatably secured in double socket mount 17, and the cylindrical end of one mount 23 is secured in boss 27 while the cylindrical end of the other ball mount 23 is secured in housing 15 in the manner illustrated in FIG. 1.

The proximate end 12A of top shaft section 12 is slidably inserted a selected distance into the second end 11B (FIG. 5) of middle shaft section 11, and is secured in end 11B with a set screw (not shown) or other desired attachment apparatus. As would be appreciated by those of skill in the art, the distance that bottom section 13 and top section 12 each extend into middle section 11 can be varied as desired to alter the overall length of the practice device 10.

Either none of the counterweights 22 or one or more of the counterweights 22 can be slidably inserted inside top shaft section 13. The proximate end 16B of adapter 16 is inserted in the distal end 12B of top shaft section 13 such that apertures 34 are aligned and in registration both with apertures 30 and with the apertures (not visible) on the opposite side of end 12B that are in registration with apertures 20. Pins (not shown in FIG. 2) comparable to pins 24 are removably inserted through said aligned apertures to secure removably adapter 16 to end 12B. The cylindrical distal end 16 of adapter 16 is secured to counterweight 21, and cover 20 is attached to counterweight 21 by inserting pin 20A to produce the position of cover 20 illustrated in FIG. 1.

The golf practice device of the invention is heavier than a comparable conventional golf club even when no counterweights 22 are placed in shaft sections 12 and 13. For example, when a nine iron club head 18 is utilized on the practice device 10 of the invention, device 10 is heavier than a conventional nine iron. Furthermore, the addition of counterweight 21 (or of additional counterweights 22A in section 12) functions to enable a golfer, on the downswing, to more quickly return the club head 18 to the golf ball and to offset the tendency of many golfers to allow the club head 18 to lag behind during the down swing. Returning the club head to the ball more quickly facilitates properly "squaring up" the club face to the ball. Counterweight 21 (or additional counterweights 22A in section 12) also functions to move the center of gravity of the practice device upwardly along the shaft of the practice device to a point 35 (FIG. 1) that is further away from club head 18 than is the case in a comparable conventional golf club. In most conventional golf clubs the center of gravity of the club is much closer to the club head 18 than point 35.

Placing counterweights 22 in section 13 can be utilized to compensate for a down swing in which the golfer is returning the club head 18 to the ball 36 (FIG. 9) too quickly. This scenario occurs, however, less frequently than the scenario in which the golfer allows his club head to lag and to return to the golf ball 36. Consequently, inserting counterweights in section 13 ordinarily occurs less frequently than does (1) inserting counterweights 22 in section 12 or (2) not inserting any counterweights in section 12 or 13 and simply relying on counterweight 21 to facilitate a quicker return of club head 18 to ball 36 during the down swing.

In use of practice device 10 of FIG. 1, the desired number of counterweights 22 are placed in the bottom and top shaft sections 13 and 12 and device 10 is assembled in the configuration depicted in FIG. 1. A golfer 37 (FIG. 9) grasps handle 25 and takes a stance addressing a golf ball. The golfer positions the device 10 such that the club head 18 is adjacent said golf ball, and the counterweight 21 is an initial operative address position adjacent, centered on, and, preferably but not necessarily, contacting the golfer's torso 40, typically either against the upper portion of the golfer's stomach or the lower portion of the golfer's chest, in the manner illustrated in FIG. 9. The golfer then takes a normal golf swing and, on the downswing, concentrates on returning the counterweight 21 to its original address position adjacent and, preferably but not necessarily, contacting the torso prior to hitting the golf ball with club head. The use of counterweight 21 in device 10 facilitates the return of the club to its original address position.

In another methodology in accordance with the invention, counterweights 22 are not placed in either shaft section 12 or shaft section 13. After the golfer 37 addresses a golf ball and places counterweight 21 in its address position adjacent the torso 40 of the golfer in the manner depicted in FIG. 9, the golfer attempts to maintain counterweight 21 adjacent and centered on the upper stomach during the first part of the back swing until the shaft 11 moves upwardly past parallel, during the downswing from when the shaft 11 moved from parallel to the ground until the club head hits the golf ball, and during the follow through until and the shaft is again parallel to the ground. This methodology helps the golfer advantageously maintain his arms in a desirable "V" orientation during a large part of the golf swing. When during the back swing the club begins to travel upwardly past parallel, counterweight 21 ordinarily will begin to move away from its original position adjacent the golfer's torso. Similarly, when on the follow through the club beings to travel upwardly past parallel, counterweight 21 ordinarily will begin to move away from its original position adjacent the golfer's torso.

If desired, shaft(s) 11, 12, 13 can be configured to store long thin rods therein. Such rods preferably are substantially rigid, but flexible, and can be removed and used on a driving range to insure that the golfer's stance is pointing in the correct direction (by placing a rod on the ground parallel to a golfer's toes), to check a golfer's swing plane (by pushing one end of a rod into the ground behind a golfer so that the remaining portion of the rod extends upwardly from the ground at an angle parallel to the desired swing plane), etc.

In one embodiment of the invention, shaft sections 12 and 13 telescope in to and out from middle shaft 11.

When counterweights 21 and 22 are utilized, more weight is concentrated near the ends of device 10, which facilitates the return of device 10 to the position occupied by device 10 when a golfer initially addresses a golf ball.

Shaft sections 12 and 13 can be configured such that the position of a counter weight 22 in or on the shaft is adjustable.

As earlier noted, the number of counter weights 22, 22A in a section 12, 13 is adjustable.

Figure 9:
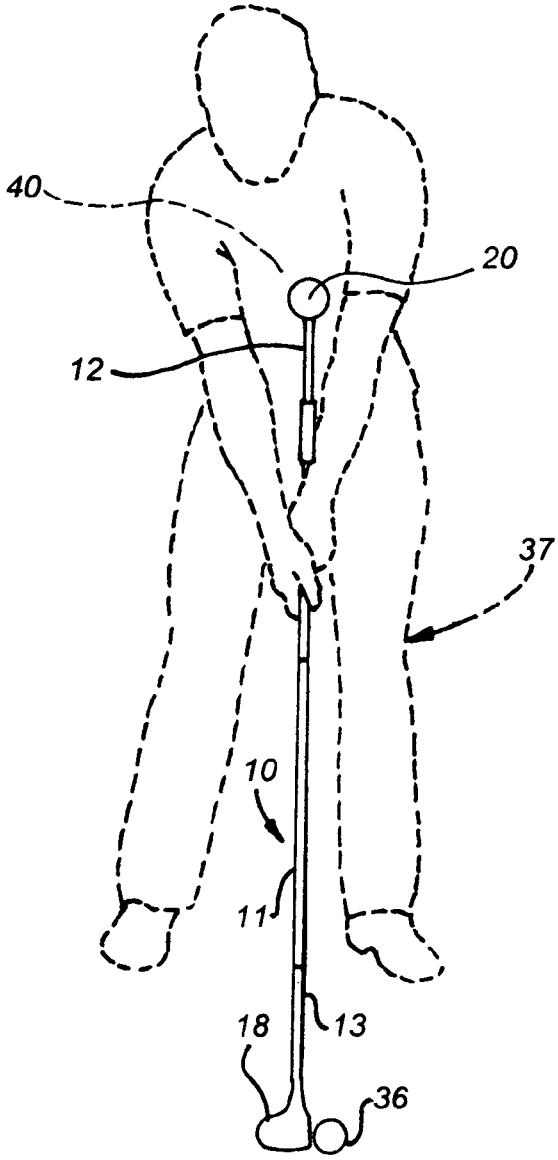
FIG. 9 is a perspective view illustrating the mode of operation of the apparatus of FIG. 1; and, FIG. 10 is a perspective view illustrating a strap anchor assembly which can be utilized in conjunction with the apparatus of FIG. 1.
Figure 10:
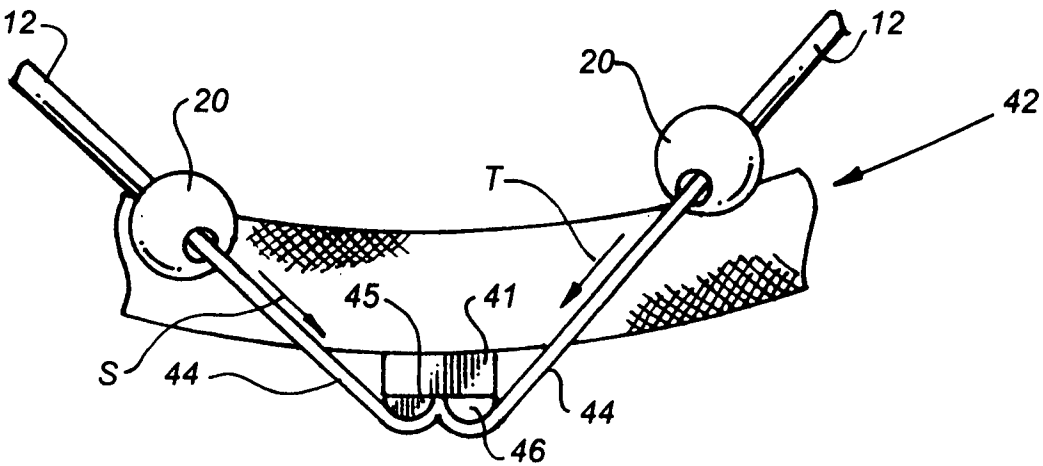

In an alternate embodiment of the invention illustrated in FIG. 10, the practice device 10 is utilized in combination with a reel 41 that includes a spring loaded wound wire 44 or other elongate member that can be deployed and rewound. Reel 41 is maintained in position over the solar plexus of a golfer by a strap 42 which extends around the lower chest and the back of a golfer. Strap 42 includes a pair of free ends (not visible) which detachably interconnect, much like a pants belt includes a pair of ends which detachably interconnect, typically with the use of a belt buckle. The free ends of strap 42 presently preferably are provided with VELCRO™ fastening material to facilitate the detachable interconnection of the free ends. The distal end of wire 44 detachably connects to housing 20 in the manner illustrated in FIG. 10. Wire 44 dispenses from reel 41 in the much same manner that a tape dispenses from a tape measure, except, however, reel 41 includes a pair of small pulley wheels 45, 46 over which reel 41 extends. When a golfer takes a club into his backswing, practice device 10 is positioned to the golfer's right (assuming a right handed golfer) and the wire 44 extends over pulley 45 in the manner illustrated in FIG. 10. When the golfer has gone through his downswing, contacted a golf ball, and is completing his swing, practice device 10 is positioned to the golfer's left and the wire 44 extends over pulley 46 in the manner illustrated in FIG. 10. As would be appreciated by those of skill in the art, although FIG. 10 illustrates practice device 10 both to the left side and right side of a golfer, during the golfer's swing practice device 10 cannot be on both sides of the golfer at the same time. During a swing, practice device 10 is either on the left side, the right side, or at the front of the golfer. When the practice device 10 is held by a golfer 37 in the address position illustrated in FIG. 9, counterweight housing 20 is adjacent reel 41. When practice device 10 moves during the backswing upwardly past a point that requires housing 20 to move away from the original position adjacent the torso that is illustrated in FIG. 9, wire 44 is pulled out of reel 41 in the manner illustrated in FIG. 10 and extends to the left hand side of reel 41 on the sheet of drawings on which FIG. 10 is drawn. Since wire 44 is spring loaded, the spring in reel 41 exerts a force, indicated by arrow S, on wire 44 that acts to draw the wire back into the reel in the direction of arrow S. Accordingly, when the golfer begins his down swing, the force S facilitates moving counterweight housing 20 (along with the distal end of section 12) back to the original position that is illustrated in FIG. 9. Similarly, when during the follow through the club moves upwardly past a point that requires housing 20 to move away from the original position adjacent the torso that is illustrated in FIG. 9, wire 44 is pulled out of reel 41 in the manner illustrated to the right hand side of reel 41 on the sheet of drawings on which FIG. 10 is depicted. Since wire 44 is spring loaded, the spring in reel 41 exerts a force, indicated by arrow T, that acts to draw the wire 44 back into the reel in the direction of arrow T.

Since strap 42 holds reel 41 in position generally over the solar plexus, reel 41 is positioned on the front of a golfer over his lower chest. Consequently, if a golfer is right handed, the left hand side of reel 41 (where arrow S is located) is actually the right hand side of the golfer; and, the right hand side of reel 41 (where arrow T is located) actually corresponds to the left hand side of the golfer.

One additional virtue of the practice device 10 is that it facilitates the proper transfer of weight to the back foot during the back swing.

Another additional virtue of the device 10 is that it helps keep the golfer's head steady and to minimize any tendency of the golfer to move his head down. This result is achieved because device 10 extends the full distance from ball 36 to the golfer's torso and prevents any significant downward movement of the golfer's torso as the golf contacts ball 36 during the down swing.

Counterweights 22 are presently utilized to add up to about two and one-half pounds of weight (in addition to counterweight(s) 21) to device 10, as desired.

Housing 15 serves at least two functions. A laser (not visible) is adjustably mounted in housing 15. When a golfer 37 addresses a ball 36 in the manner illustrated in FIG. 9, the laser can be directed at a point on the ground just forwardly of club head 18. During the back swing, golfer 37 can watch the laser point move over the ground. During the first two to three feet of movement of the laser point along the ground, the point generally preferably moves along an imaginary line that is generally parallel to the front of the golfer's body. The golfer can use his peripheral vision to track the movement of the laser point over the ground during the back swing and/or during the down swing. The laser can also, if desired, be pointed at the torso adjacent housing 20 to assist a golfer in tracking device 10 during a swing.

The semi-circular face 15A of housing 15 is preferably parallel to the lower edge 18A of the club head. This permits the golfer 37 to utilize his peripheral vision to view face 15A to determine if edge 18A of the club head 18 is in the proper position, i.e. perpendicular to the ground—at the top of the back swing.

Having described the invention and presently preferred embodiments and the best modes thereof in such terms as to enable one of skill in the art to make and use the invention,

I claim:

1. An elongate golf practice device comprising (a) an elongate hollow shaft assembly having a length greater than that of a comparable conventional golf club, shaped and dimensioned to extend from a golfer's torso to the ground, and including a top section having a proximate end and a distal end, a bottom section having a proximate end and a distal end, a hollow middle section extending between and interconnecting said proximate ends of said top and said bottom sections;

(b) a handle on said middle section;

(c) a club head attached to said distal end of said bottom section;

(d) a first counterweight attached to said distal end of said top section and spaced apart from said handle;

said golf practice device having (e) a weight greater than that of a comparable conventional golf club;

(f) a center of gravity spaced along said middle section a distance from said club head greater than the distance the center of gravity of a comparable conventional golf club is spaced apart from the club head of the conventional golf, and (g) a strap assembly shaped and dimensioned to extend around the golfer's torso and connected to said distal end of said top section to secure said distal end of said top section adjacent the golfer's torso.

2. A method to practice a golf swing, comprising the steps of (a) providing a golf practice device comprising (i) an elongate hollow shaft assembly having a length greater than that of a comparable conventional golf club, shaped and dimensioned to extend from a golfer's torso to the ground, and including a top section having a proximate end and a distal end, a bottom section having a proximate end and a distal end, a hollow middle section extending between and interconnecting said proximate ends of said top and said bottom sections, (Ii) a handle on said middle section, (iii) a club head attached to said distal end of said bottom section (iv) a first counterweight attached to said distal end of said top section and spaced apart from said handle, (v) a strap assembly shaped and dimensioned to extend around the golfer's torso and connected to said distal end of said top section to secure said distal end of said top section adjacent the golfer's torso, said golf practice device having (v) a weight greater than that of a comparable conventional golf club, and, (vi) a center of gravity spaced along said middle section a distance from said club head greater than the distance the center of gravity of a comparable conventional golf club is spaced apart from the club head of the conventional golf club;

(b) mounting said strap assembly on the torso of the golfer with said distal end of said top section positioned adjacent the torso of the golfer;

(c) grasping said handle of said golf practice device;

(d) taking a stance addressing a golf ball;

(e) positioning said golf practice device such that (i) said club head of said golf practice device is adjacent the ground and said golf ball, and (ii) said first counterweight is in an operative position adjacent the torso; and, (f) swinging said golf practice device while (i) during the initial part of the back swing generally maintaining said first counterweight adjacent the torso, and (ii) during the down swing just prior to and just after contacting said golf ball with said club head of said golf practice device maintaining said first counterweight adjacent the torso.

3. A method to practice a golf swing, comprising the steps of (a) providing a golf practice device comprising (i) an elongate shaft assembly shaped and dimensioned to extend from a golfer's torso to the ground, and including a top section having a proximate end and a distal end, a bottom section having a distal end, a middle section extending between and interconnecting said top and said bottom sections, (Ii) a handle on said middle section, (iii) a club head attached to said distal end of said bottom section, (iv) a strap assembly shaped and dimensioned to extend around the golfer's torso and connected to said distal end of said top section to secure said distal end of said top section adjacent the golfer's torso, said golf practice device having a center of gravity spaced therealong between said distal end of said bottom section and said distal end of said top section;

(b) mounting said strap assembly on the torso of the golfer with said distal end of said top section positioned adjacent the torso of the golfer;

(c) grasping said handle of said golf practice device;

(d) taking a stance addressing a golf ball;

(e) positioning said golf practice device such that (i) said club head of said golf practice device is adjacent the ground and said golf ball, and (ii) said club head is in a first operative position; and, (f) swinging said golf practice device while (i) during the initial part of the back swing generally moving said club head away from said first operative position, and (ii) during the down swing and after contacting said golf ball with said club head of said golf practice device moving said club head away from said first operative position.

* * * * *